United States Patent [19]

Lewis

[11] Patent Number: 4,798,508

[45] Date of Patent: Jan. 17, 1989

[54] MACHINE AND METHOD FOR OPENING A FILLED BAG, EMPTYING THE BAG, AND DISPOSING OF THE EMPTY BAG

[75] Inventor: John W. Lewis, Baton Rouge, La.

[73] Assignee: The Dow Chemical Company, Midland, Mich.

[21] Appl. No.: 172,929

[22] Filed: Mar. 25, 1988

[51] Int. Cl.[4] ..... B65G 65/04; B65B 69/00

[52] U.S. Cl. ..... 414/412; 53/381 R; 53/492

[58] Field of Search ..... 53/381 R, 492; 414/411, 414/412

[56] References Cited

U.S. PATENT DOCUMENTS

| | | | |
|---|---|---|---|
| 2,660,324 | 11/1953 | Trautschold | 414/412 |
| 3,482,718 | 12/1969 | Moriarty | 414/412 |
| 4,119,227 | 10/1978 | Hafner et al. | 414/412 |
| 4,504,183 | 3/1985 | Bennison et al. | 414/412 |
| 4,725,184 | 2/1988 | Bennison | 53/381 R X |

FOREIGN PATENT DOCUMENTS

| | | | |
|---|---|---|---|
| 1315853 | 5/1973 | United Kingdom | 414/412 |
| 2060545 | 5/1981 | United Kingdom | 414/412 |

*Primary Examiner*—Robert L. Spruill
*Assistant Examiner*—Ann Tran
*Attorney, Agent, or Firm*—V. Dean Clausen

[57] ABSTRACT

The invention is a machine and method for opening a filled bag and emptying the contents of the bag. A bag filled with a solid material is guided into a space between a pair of rotating drums, in which there are several rows of rigid spikes fastened to each drum. The spikes extend through the drum walls and through openings in a belt that connects each drum to an idler roller. When the filled bag enters the space between the drums, it becomes impaled on the spikes, and is drawn into a cutter means. The cutter means slits the bag in half to empty the contents, and each empty bag half is carried on one of the rotating drums to a point where the spikes move away from the belt to release the empty bag half.

7 Claims, 3 Drawing Sheets

MACHINE AND METHOD FOR OPENING A FILLED BAG, EMPTYING THE BAG, AND DISPOSING OF THE EMPTY BAG

BACKGROUND OF THE INVENTION

The invention relates broadly to a machine for automatically opening a filled bag and emptying the contents of the bag. More specifically, the machine described herein slits a filled bag to divide it into sections, empties the bag, and disposes of the bag sections.

Various materials in powder or granular form are packed in bags for commercial or domestic use. Some of these bagged materials, such as asbestos, are of a dusty or noxious nature. To prevent the dusty material from contaminating the atmosphere, where it can be hazardous to plant workers and detrimental to equipment, there are machines available that can open the filled bags and empty the contents within a closed system.

An example of such a machine is an automatic bag slitting machine, which is manufactured by Bel-Tyne International, Inc., of York, Pa. In a typical operation of the machine, a filled bag is automatically centered between rotating drums equipped with retractable spikes. As the filled bag moves into contact with the drums, a cam mechanism causes the spikes to emerge from inside the drum and to impale the filled bag. The spikes grip the bag and move it downwardly onto a reciprocating cutter blade. The blade cuts the bag completely in half (two sections), to empty the contents into a collector unit. As the bag continues to move through the machine, the two separated bag sections are drawn around each drum. When the rotating drums reach a given point, the spikes retract back into the drum. The intended purpose of retracting the spikes is to permit each bag section to release from its drum, so it can drop into a disposal unit.

The machine described above has certain drawbacks, which make the bag-opening operation less than satisfactory. One of the problems is caused by the design of the spikes. For example, each drum has only a few spikes, and they are of large diameter. This makes it difficult for the spikes to pierce the bag section and hold onto it. The result is an inconsistent cutting and tearing of the empty bag sections, which causes parts of each bag to fall into the collector unit along with the contents of the bag. Another problem is caused when the tips of the spikes don't pull back into the drum far enough to completely release the empty bag section. When this happens, the bag sections can become entangled in the moving cutter blade, which can cause the cutter mechanism to stop: and usually, pieces of the bag will fall into the collector unit.

SUMMARY OF THE INVENTION

The invention is a machine and method for automatically slitting a filled bag to divide the bag into sections, emptying the contents of the bag, and disposing of the empty bag sections. The major components of the machine are two gripper units. Each gripper unit comprises a rotatable drum having several rows of rigid spikes that are fastened to the inside of the drum and extend outwardly from an outside wall surface of the drum. The drums are spaced apart, the spikes in each row are spaced apart, and each row of spikes is spaced from an adjacent row.

Each gripper unit also includes a belt means that connects the rotatable drum to an idler roller. Both of the belt means have openings therein, and the spikes on each drum extend through these openings and beyond the belt means. A drive means is provided, which rotates the drums simultaneously, each drum being rotated in a direction opposite from the other drum. The machine includes a means for guiding a filled bag into the space defined between the rotating drums. Another component is a cutter means positioned adjacent to the rotating drums and designed to engage a filled bag and cut it into sections.

In the operation of the machine, a bag filled with material enters the space between the rotating drums and becomes impaled on the spikes. The rotating drums move the bag against the cutter means, which slits the bag, to divide it into sections. The contents of the bag fall away from the rotating drums, and each bag section is carried on the spikes of one of the rotating drums to a point where the moving belt means causes the bag section to fall away from the drum.

DESCRIPTION OF THE INVENTION

Figures 1, 5:
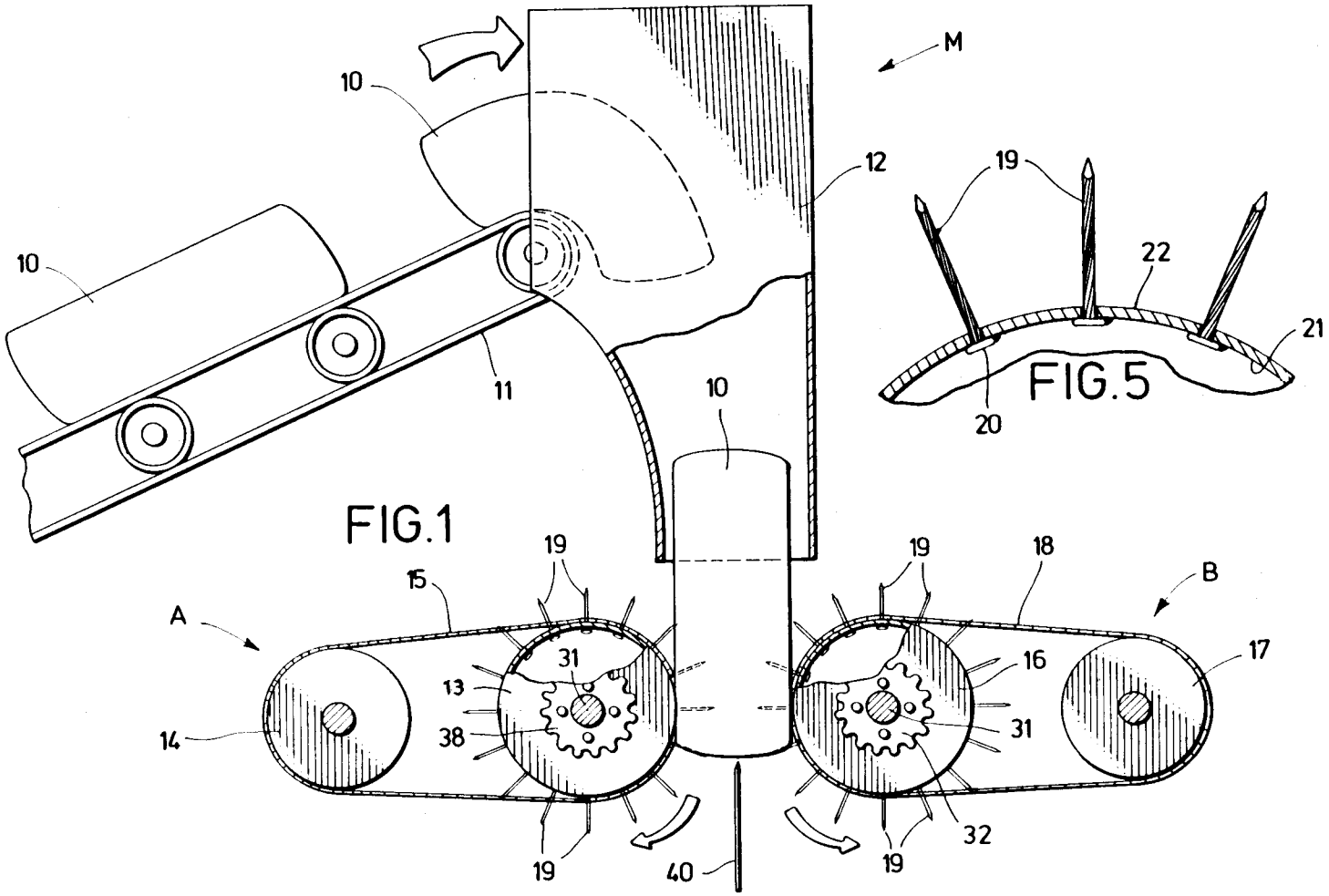
FIG. 1 is an elevation view, mostly in schematic, of a machine designed for opening filled bags, according to this invention. In this view the filled bag is being gripped between a pair of rotatable spiked drums.
FIG. 5 is an enlarged view, partly in section, of a segment of one of the spiked drums. This view illustrates how the spikes are fastened into each drum.

Referring to the drawings, particularly FIG. 1, the letter M indicates generally the bag-opening machine of this invention. As shown in FIG. 1, bags filled with a solid material, as indicated by the numeral 10, are transported by a conveyor belt 11 into a guide chute 12 at the top of the machine M. The machine includes two gripper units of identical structure, designated as a left gripper unit A and a right gripper unit B. Looking first at gripper unit A, this structure includes a rotatable drum 13, which is connected to an idler roller 14 by a belt 15. The gripper unit B also consists of a rotatable drum 16, which is connected to an idler roller 17 by a belt 18.

Several rows of rigid spikes 19 are fastened to each of the drums 13 and 16, to provide means for gripping the filled bag 10 as it enters the space between the rotating drums. The preferred method of fastening the spikes to the drums is illustrated in FIG. 5. The head 20 of each spike 19 is tack welded to the inside wall surface 21 of each drum, so that the shank of the spike extends through the drum wall and outwardly from the outside wall surface 22 of the drum. As the drawings indicate, particularly FIG. 4, the spikes 19 are arranged in rows on each of the drums. Within each row the spikes are spaced apart, and each row is spaced from an adjacent row.

Figure 4:
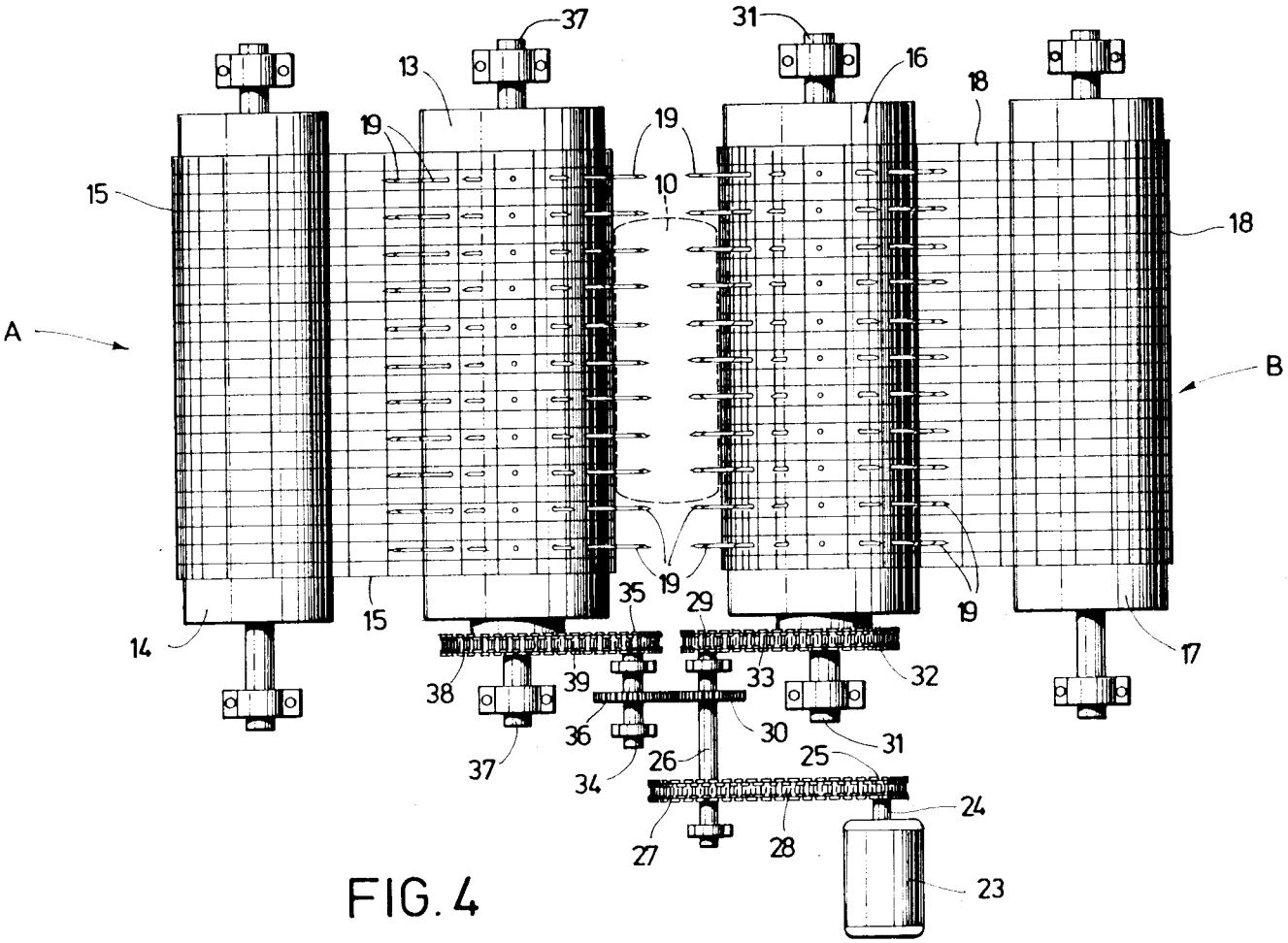
FIG. 4 is a plan view of the bag-opening machine. This view includes a drive means for rotating the spiked drums.

The machine includes a drive means for simultaneously rotating the spiked drums 13 and 16, as illustrated in FIG. 4. The drive means includes a motor 23 having a shaft 24 with a driver sprocket 25 mounted on the end of the motor shaft. Adjacent to motor 23 is a main drive shaft 26, which has a driven sprocket 27 mounted near the outer end of the shaft. Driver sprocket 25 on motor shaft 24 is connected by chain member 28 to the driven sprocket 27 on drive shaft 26. At the forward end of drive shaft 26 is a driver sprocket 29, and behind the sprocket is a spur gear 30. In FIG. 4 the sprockets 25 and 27 are hidden by the chain member 28 which engages both sprockets.

Figure 2:
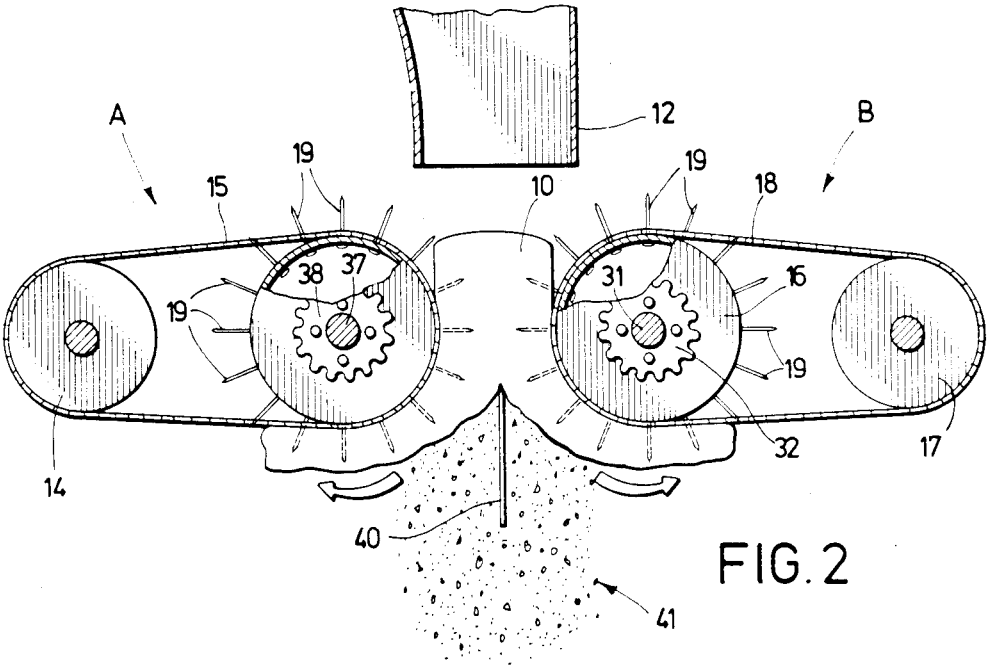
FIG. 2 is an elevation view, in schematic, of the spiked drums and a cutter means of the machine illustrated in FIG. 1. In this view the filled bag has been cut in half by the cutter means, to empty the contents of the bag.
Figure 3:
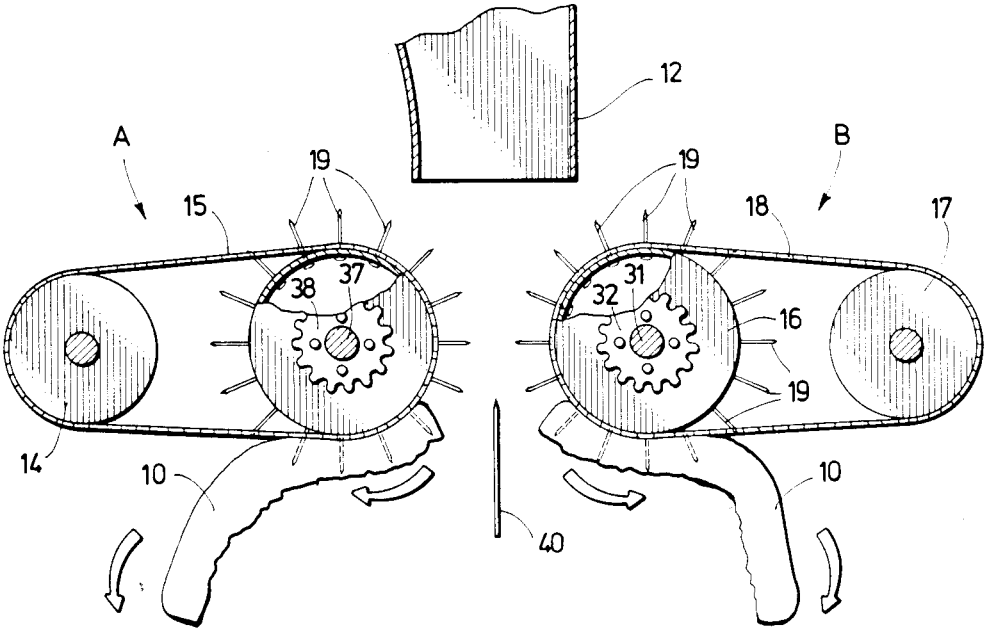
FIG. 3 is an elevation view, in schematic, of the spiked drums shown in FIGS. 1 and 2. This view illustrates how the empty bag halves are removed from the spiked drums by a moving belt that engages each drum.

The rotatable drum 16 fits onto a shaft 31, and a driven sprocket 32 is mounted on this shaft at the forward end of the drum, as shown in FIGS. 1–3. A chain member 33 connects the driver sprocket 29 to the driven sprocket 32. In FIG. 4 the sprockets 29 and 32 are hidden by the chain member 33. A secondary drive shaft 34 is positioned adjacent to the main drive shaft 26. At the forward end of shaft 34 is a driver sprocket 35, and behind the sprocket is a spur gear 36, which engages the spur gear 30 on shaft 26. The rotatable drum 13 fits onto a shaft 37, and a driven sprocket 38 is mounted on this shaft at the forward end of the drum. A chain member 39 connects the driver sprocket 35 to the driven sprocket 38.

Means for slitting the bag 10, to empty the contents of the bag, is provided by a blade 40 that is moved back and forth by any of various drive mechanisms (not shown). A moving saw blade, or knife blade, are representative of a cutter means that can be used in the practice of this invention. As shown in FIGS. 1–3, the blade 40 is positioned adjacent to the rotatable drums 13 and 16, such that the blade is in direct alignment with the space defined between the drums. Referring to the belts 15 and 18, which connect the rotatable drums 13 and 16 to the idler rollers 14 and 17, it is preferred to use a flat wire conveyor belt of a commercial design. Other types of commercially available belts that could be used include roller chain belts, or web belts with holes in them that would allow the belt to fit down over the spikes 19.

OPERATION

The practice of this invention can be illustrated by describing a typical operation in which bags filled with asbestos fibers are opened and emptied. As illustrated in FIG. 1, the filled bags 10 are transported by conveyor 11 up into the guide chute 12. From the conveyor, a single bag 10 will move down through the chute and enter the machine M in the space between the rotating drums 13 and 16. As the bag moves into this space, it is impaled on the rigid spikes 19 that are fastened to the drums. The spikes thus hold onto the bag 10 and pull it downwardly onto the moving blade 40.

As shown in FIG. 2, the blade 40 moves along the lengthwise dimension of the bag 10 and cuts it in half. With the bag being split open, the fibrous material 41 falls away from the rotating drums and into a collector tank (not shown). Looking now at FIG. 4, one of the empty bag halves 10 is held fast to the drum 16 until the belt reaches a point where the spikes 19 move away from the belt. At this point the spikes can no longer hold onto the bag half and it falls away from the belt 18 into a collector unit (not shown). For the other bag half 10, which is held fast to drum 13, it is released from the drum in the same manner as described above.

The invention claimed is:

1. A machine for slitting a filled bag to divide the bag into sections, emptying the contents of the bag, and disposing of the empty bag sections, the machine comprising:

a first gripper unit and a second gripper unit:

each gripper unit includes a rotatable spiked drum having an outside wall surface, the drums being spaced apart, several rows of rigid spikes being fastened to each drum, the spikes extending outwardly from the outside wall surface of each drum, the spikes in each row being spaced apart, and each row of spikes being spaced from an adjacent row:

each gripper unit further includes a belt means and an idler roller, with each belt means connecting the rotatable spiked drum to the idler roller, each belt means having openings therein, with the spikes on each drum extending through these openings and beyond the belt means:

a drive means for simultaneously rotating the spiked drums in each gripper unit, each drum being rotated in a direction opposite from that of the other drum;

a guide means positioned adjacent to the rotatable drums in each gripper unit, for guiding a filled bag into the space defined between the rotatable drums:

a cutter means positioned adjacent to the rotatable drums in each gripper unit and in direct alignment with the space defined between said drums, the cutter means being adapted to engage a filled bag and cut the bag into sections, and the rotational direction of each drum being such that the filled bag is moved into contact with the cutter means;

wherein, in operation, the filled bag enters the space between the rotating spiked drums and becomes impaled on the spikes, the rotating drums move the impaled bag against the cutter means, the cutter means slits the bag to divide it into sections, the contents of the bag fall away from the rotating drums, and each bag section is carried on the spikes of one of the rotating drums to a point where the moving belt means causes the bag section to be released from each drum.

2. The machine of claim 1 in which the drive means comprises:

a motor, a motor shaft, and a driver sprocket mounted on the motor shaft:

a main drive shaft, on which is mounted a driven sprocket, a spur gear, and a driver sprocket;

a secondary drive shaft, on which is mounted a spur gear and a driver sprocket:

each of the rotatable spiked drums being mounted on a shaft, with a driven sprocket being mounted on each of said shafts: and the driver sprocket on the motor shaft being connected by a chain member to the driven sprocket on the main drive shaft, the spur gear on the main drive shaft engaging the spur gear on the secondary drive shaft, the driver sprocket on the main drive shaft being connected by a chain member to the driven sprocket on one of the rotatable spiked drums, and the driver sprocket on the secondary drive shaft being connected by a chain member to the driven sprocket on the other rotatable spiked drum.

3. The machine of claim 1 in which the guide means is a chute, the chute being positioned directly above the space defined between the rotatable spiked drums.

4. The machine of claim 1 in which the belt means of each gripper unit is a flat wire conveyor belt.

5. The machine of claim 1 in which the cutter means slits the bag along its lengthwise dimension, to divide the bag into two sections.

6. The machine of claim 1 in which the cutter means is a moving blade.

7. A method for automatically slitting a filled bag to divide the bag into sections, emptying the contents of the bag, and disposing of the empty bag sections, comprising the steps of:

providing a pair of spaced-apart drums having several rows of rigid spikes fastened to each drum, a drive means for rotating the drums, and each drum being connected to an idler roller by a belt means that moves around each drum as it rotates:

guiding a bag filled with a solid material into the space defined between the rotating drums:

causing the bag to become impaled on the spikes fastened to the rotating drums:

moving the impaled bag on the rotating drums to a point where the bag comes into contact with a cutter means:

slitting the filled bag with the cutter means to divide the bag into two sections:

allowing the contents of the divided bag to fall away from the rotating drums: and carrying each empty bag section on one of the rotating drums to a point where the spikes on each drum move away from the moving belt, to thereby cause the bag sections to release from each drum.

* * * * *